US009664206B2

(12) United States Patent
Lehnert

(10) Patent No.: US 9,664,206 B2
(45) Date of Patent: May 30, 2017

(54) PRESSURE ACCUMULATOR

(71) Applicant: HYDAC TECHNOLOGY GMBH, Salzbach/Saar (DE)

(72) Inventor: Markus Lehnert, Dillingen (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 0 days.

(21) Appl. No.: 15/036,438

(22) PCT Filed: Jan. 13, 2015

(86) PCT No.: PCT/EP2015/000040

§ 371 (c)(1),
(2) Date: May 13, 2016

(87) PCT Pub. No.: WO2015/113731

PCT Pub. Date: Aug. 6, 2015

(65) Prior Publication Data

US 2016/0258449 A1 Sep. 8, 2016

(30) Foreign Application Priority Data

Feb. 1, 2014 (DE) ..... 10 2014 001 283

(51) Int. Cl.
*F15B 1/10* (2006.01)
*F15B 1/22* (2006.01)

(52) U.S. Cl.
CPC ..... *F15B 1/103* (2013.01); *F15B 1/22* (2013.01); *F15B 2201/205* (2013.01); *F15B 2201/3152* (2013.01); *F15B 2201/3153* (2013.01); *F15B 2201/413* (2013.01); *F15B 2201/50* (2013.01)

(58) Field of Classification Search
CPC ..... F15B 2201/205; F15B 2201/4155; F15B 2201/3153; F15B 2201/3158; F15B 2201/00; F16L 55/053; F16L 55/043
USPC ..... 138/31, 30; 206/459.1; 220/530; 73/1.73
See application file for complete search history.

(56) References Cited

U.S. PATENT DOCUMENTS 4,213,545 A * 7/1980 Thompson ..... B67D 1/0462 138/30
4,432,393 A 2/1984 Mills
4,608,870 A * 9/1986 Huber ..... F15B 1/24 200/82 E (Continued)

FOREIGN PATENT DOCUMENTS

DE 101 19 357 10/2002
DE 102 42 104 9/2003

(Continued)

OTHER PUBLICATIONS

International Search Report (ISR) issued May 18, 2015 in International (PCT) Application No. PCT/EP2015/000040.

*Primary Examiner* — Patrick F Brinson
(74) *Attorney, Agent, or Firm* — Wenderoth, Lind & Ponack, L.L.P.

(57) ABSTRACT

A pressure accumulator includes an accumulator housing (2) in which a movable separating element (30) fluid-tightly separates a gas chamber (16) filled with a working gas from a fluid chamber (28). A monitoring device (50, 54) supplies an optical signal in the event of a malfunction affecting the sealing effect of the separating element (30).

19 Claims, 2 Drawing Sheets

(56) References Cited

U.S. PATENT DOCUMENTS

| | | | | |
|---|---|---|---|---|
| 4,644,976 | A * | 2/1987 | Peter | F15B 1/24 138/31 |
| 4,691,739 | A * | 9/1987 | Gooden | H05K 7/20272 138/31 |
| 5,027,860 | A | 7/1991 | Tuthill, Jr. | |
| 5,520,053 | A * | 5/1996 | Weber | F15B 1/08 138/31 |
| 5,654,499 | A | 8/1997 | Manuli | |
| 7,234,490 | B2 * | 6/2007 | Dorr | F15B 1/24 138/26 |
| 8,365,651 | B2 * | 2/2013 | Dorr | F15B 1/08 92/5 R |
| 2003/0056711 | A1 * | 3/2003 | Tranter | F15B 1/08 116/272 |
| 2007/0044461 | A1 | 3/2007 | Burdick et al. | |
| 2008/0179333 | A1 * | 7/2008 | Fuller | F24D 3/1016 220/530 |
| 2014/0060688 | A1 | 3/2014 | Jirgal et al. | |
| 2014/0158573 | A1 * | 6/2014 | Van Haaren | F16L 55/053 206/459.1 |
| 2015/0345802 | A1 * | 12/2015 | Van Haaren | F24D 3/1008 220/721 |

FOREIGN PATENT DOCUMENTS

| | | |
|---|---|---|
| DE | 10 2011 100 532 | 11/2012 |
| EP | 0 695 902 | 2/1996 |
| EP | 1 760 324 | 3/2007 |
| GB | 875 224 | 8/1961 |

* cited by examiner

PRESSURE ACCUMULATOR

FIELD OF THE INVENTION

The invention relates to a pressure accumulator having an accumulator housing. A movable separating element separates a gas chamber filled with a working gas from a fluid chamber in a fluid-tight manner in the accumulator housing.

BACKGROUND OF THE INVENTION

Hydro-pneumatic accumulators of this type are prior art. They are widely used in fluid systems and hydraulic systems, for example, as a pulsation dampers for smoothing pressure fluctuations or for storing hydraulic energy. The publication EP 1 709 334 B1, for example, discloses a pressure accumulator of this type in the form of a bellows accumulator, which is provided, in particular, as a pulsation damper. Crucial for the functionality of such accumulators is that the separating element forms an absolute separation between the working chambers, gas side and fluid side, and maintains this separation during operation. A defect appearing on the separating element, whether it is a folding bellow or a membrane, which defect results in the transfer of fluid to the gas side and, therefore in the reduction of the gas volume, results in the progressive reduction of the damping effect in the case of pulsation dampers or in the loss of storage capacity in the case of energy stores.

Movable separating elements in the form of folding bellows or elastomer membranes are subjected to high mechanical stresses during operation. The risk then exists of a rupture during operation. During operation of pressure accumulators, detecting such a disruption quickly and timely enough to be able replace the accumulator before a malfunction or a failure of an affected associated system occurs is difficult.

SUMMARY OF THE INVENTION

In view of this problem, an object of the invention is to provide an improved pressure accumulator, which ensures an enhanced operating reliability in connection with a fluid system or hydraulic system to which it is allocated.

According to the invention, the object is basically achieved by a pressure accumulator having, as an essential feature of the invention, a monitoring device, which supplies a visually detectable signal in the event of a disruption that adversely affects the sealing effect of the separating element. This monitoring device provides the advantageous possibility of carrying out the functional capability of the pressure accumulator during continuous operation, i.e., without having to remove the pressure accumulator from the system and subjecting it to external functional testing. Thus, the removal of an affected pressure accumulator from the system is required only if the occurrence of a disruption is signaled. The defective pressure accumulator can therefore be replaced before a more serious operational disruption or operational failure of the allocated system occurs, so that an improved operating reliability may be achieved.

The invention is particularly advantageously provided in the case of a pressure accumulator, which has a folding bellows as a separating element, in particular, in the form of a metal bellows. Folding bellows, in particular, metal bellows are preferably used in pulsation dampers, where high mechanical alternating stresses occur on the bellows during operation, in particular, at the folds. A corresponding risk of a defect occurring exists. Thus, the possibility of monitoring provided by the invention proves to be particularly advantageously.

The monitoring device may particularly advantageously include a viewing window on the wall of the housing, through which an indicator is preferably observable. The indicator is connected to the gas chamber. The visual properties of the indicator noticeably change when wetted with fluid. Because a transfer of fluid to the gas side is detectable by observing an indicator through the viewing window, it allows functional monitoring to be carried out during continuous operation in a particularly easy and reliable manner.

An indicator that changes its color when wetted can be particularly advantageously provided.

In advantageous exemplary embodiments, a sample quantity of glass-fiber wool is provided as an indicator. That wool is white in the non-wetted state and becomes visually noticeably discolored in various ways when wetted with fluids of various types. During an operation with a fluid in the form of hydraulic oil, a potential leak is detectable by a relatively dark discoloration of the glass-fiber wool. When using the pressure accumulator in fuel systems, a wetting by diesel oil, on the other hand, results in a lighter discoloration. For example, gasoline or ethylene glycol results in a yellower or orange-colored discoloration, i.e., in discolorations that differ clearly noticeably from the white initial state of the glass-fiber wool.

In advantageous exemplary embodiments, the glass-fiber wool is disposed in a bore passing through the wall of the housing into the gas chamber.

The bore may be closed on the housing outer side by a threaded insert, which includes a pressure-resistant viewing window. In a particularly advantageous manner, the glass-fiber wool is disposed in the bore between threaded insert including the viewing window and a screen body located at the inner end of the bore. An observation just through the viewing window or sight glass can suffice for an operator or maintenance person to be able to detect damage to the separating element, even without an indicator.

In a particularly advantageous manner, the bore is designed as a continuous threaded bore, to the inner end of which a threaded ring, which forms the holder for the screen body, may be screw-fastened. This arrangement results in a particularly simple structural design for the monitoring device.

In pressure accumulators having a cylindrical housing that includes a housing cover at one end forming an axial housing closure, advantageously the bore of the monitoring device can be designed to be in the housing cover.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
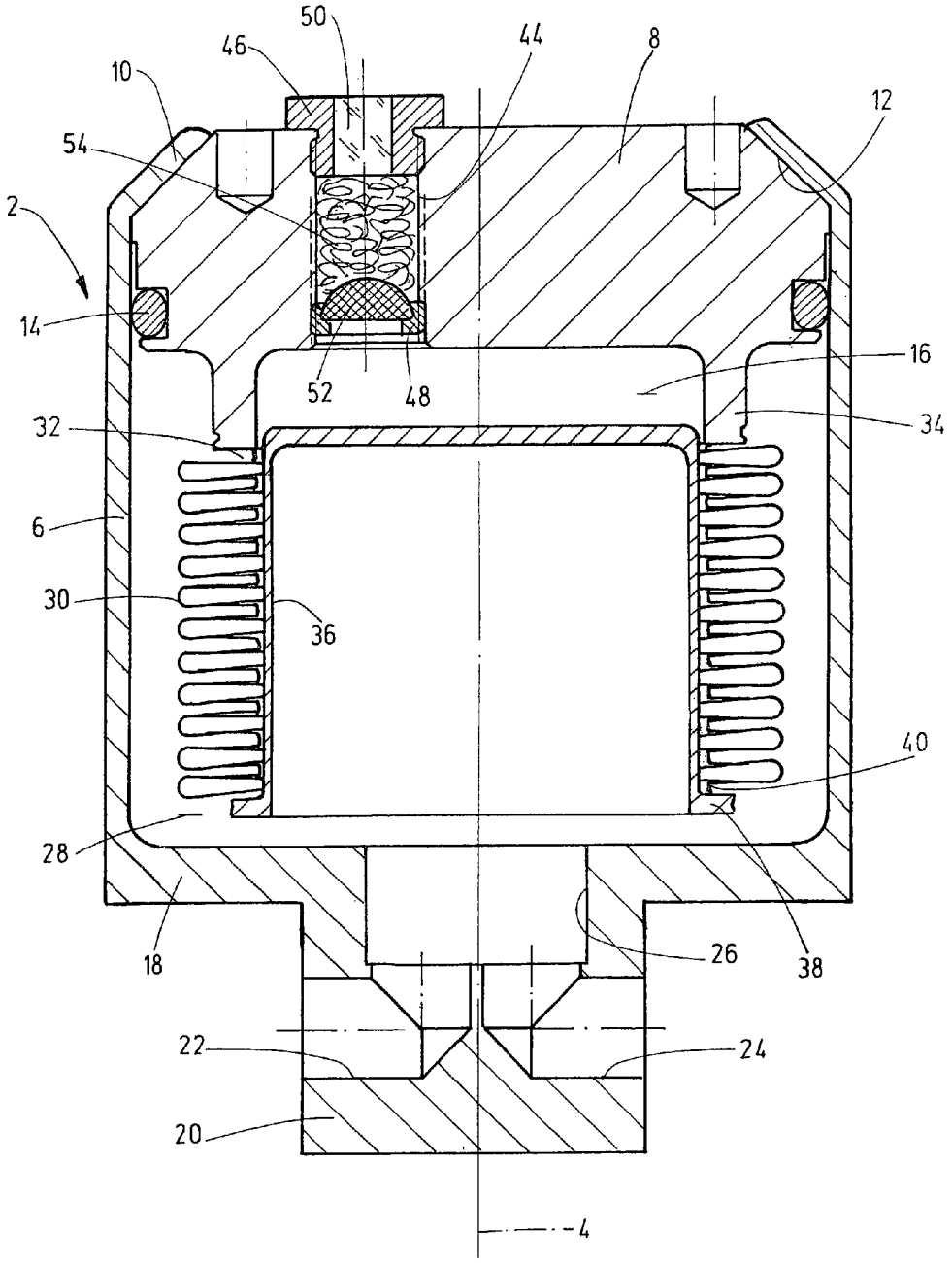
FIG. 1 is a side view in section of a pressure accumulator according to an exemplary embodiment of the invention.
Figure 2:
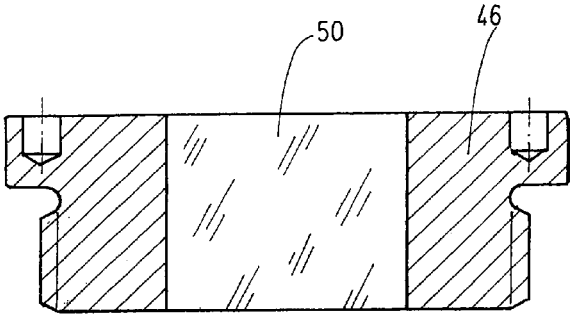
FIG. 2 is a side view in section of the threaded insert of the exemplary embodiment of the pressure accumulator, including a viewing window, drawn on a larger scale as compared to FIG. 1.

The exemplary embodiment of a pressure accumulator in the form of a metal bellows accumulator is depicted in the drawing, in particular for a use in hydraulic systems and fuel facilities, to dampen and to smooth pressure surges in the operating medium. In the area of fuel systems, the operating medium includes, in particular, diesel fuel, gasoline or the like. A pressure accumulator could also be used in conjunction with electrohydraulic brake systems, for example, in automotive construction. The pressure accumulator depicted has an accumulator housing 2, having a substantially circular cylindrical, pot-shaped main section 6, defining a longitudinal axis 4. One end of the main section 6 has a housing cover 8 as a housing closure, which is connectable to the main section 6 by the folding of its end edge 10 onto a diagonal surface 12 of the cover 8. An O-ring 14 forms the seal. The folded over end edge 12 may be connected to the housing cover 8 by an additional weld (not depicted). A filling connection (also not depicted) for introducing a working gas, such as $N_2$, into a working chamber on the gas side, which is identified in FIG. 1 as gas chamber 16, may also be provided in the housing cover 8.

The main section 6 of the accumulator housing 2 includes a base 18 at the end opposite the cover 8. A fluid connection on the base 18 has a cylindrical connecting element 20 coaxial to the longitudinal axis 4. The base includes two fluid connections 22, 24, which open into a common entrance chamber 26, which leads to the fluid side 28 in the housing 2. In the present exemplary embodiment, a metal bellows 30, which, as in the aforementioned pressure accumulator disclosed EP 1 709 334 B1, is tightly connected by welding at its one end 32 to an inner annular extension 34 of the cover 8, and is provided as a separating element between the gas chamber 16 and the fluid chamber 28. The metal bellows 30 surrounds the outer side of a circular cylindrical, inner pot body 36, which is open at the end facing the housing base 18. The other bellows end 40 is tightly connected by welding to the open edge 38 of the pot body 36.

To form the monitoring device, which signals a transfer of fluid from the fluid chamber 28 to the gas chamber 16 resulting from a bellows rupture, a continuous threaded bore 44 is formed in the housing cover 8 in the present exemplary embodiment, displaced laterally relative to the longitudinal axis 4. The outer end of the threaded bore 44 is tightly sealed by a threaded insert 46. A threaded ring 48 may be screwed into the inner end of the threaded bore 44. The outer threaded insert 46 is formed by a screwed sight glass, which includes a viewing window 50 made of a pressure-resistant glass. In the present example, a screw sight glass, available commercially under the name "Metaglas", which includes a viewing window 50 made of borosilicate glass, is provided by Herberts Industrieglas, Gewerbeschulstr. 72, D-42289 Wuppertal, Germany. The threaded ring 48, which is screwed into the threaded bore 44 at the inner end thereof, supports a screen body 52. The screen body forms a support for a glass-fiber wool 54, provided as an indicator, which is located between the screen body 52 and the viewing window 50 of the threaded insert 46.

Figure 3:
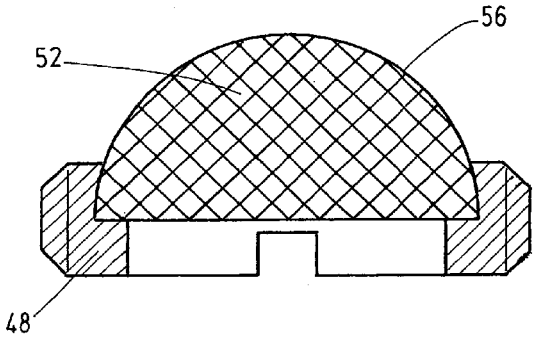
FIG. 3 is a side view in section of a threaded ring with screen body of the pressure accumulator, drawn on a larger scale as compared to FIG. 1.
Figure 4:
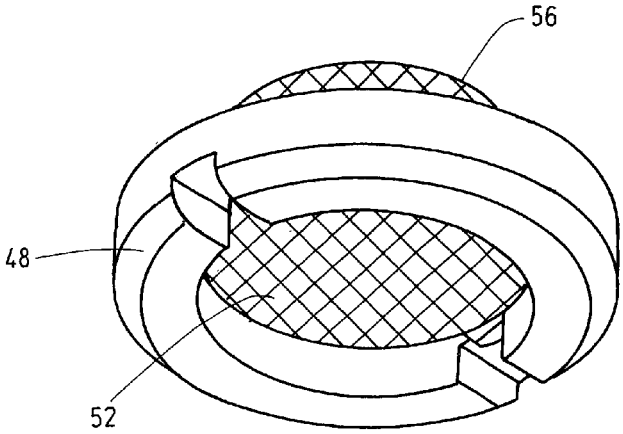
FIG. 4 is a perspective view of the threaded ring of FIG. 3.

As shown most clearly in FIGS. 3 and 4, the screen body 52 has the shape of a hemispherical cupola, made of a metallic structural webbing, in the present example, having a mesh size of 0.1 mm. A support webbing 56, also metallic, having a mesh size of 0.83 mm with a wire thickness of 0.22 mm, extends over the outer side of the structural webbing.

The glass-fiber wool 54, which is white in its unwetted original state, becomes discolored when wetted with fluid that passes from the fluid chamber 28 to the gas chamber 16 in the case of a defect in the separating element, in the present case, a bellows rupture. In the case of fluids, such as hydraulic oil or diesel fuel, the result is a strong dark coloration of the glass-fiber wool 54 observable via the viewing window 50. Other fluids, depending on their color, result in different discolorations of the indicator, for example, in lighter discolorations in the case of gasolines and the like. In any case, the wetting of the glass-fiber wool 54 functioning as the indicator is clearly detectable through the viewing window 50. Instead of the glass-fiber wool 54, other substances can be provided as an indicator, which noticeably alter their optical property when wetted with the fluids in question in a visually noticeable manner, in particular, become discolored. The original state of the unwetted indicator need not necessarily be white.

A simplified exemplary embodiment is described above, in which visual changes to the indicator are immediately noticeable visually by observation through the viewing window 50. The invention may be used with equal advantage if relevant pressure accumulators are installed in such a way that a direct eye contact for visual observation of the viewing window 50 is not possible. In such cases, an optical sensor device of a known type may be provided, for example, including a light source that illuminates the indicator through the viewing window 50. Any substance, which, when wetted, changes its optical property or reflectivity in a manner detectable by a sensor device, may be considered. As stated previously, color changes need not start with white as the original state. They may also involve monochrome changes in reflectivity.

The viewing window 50 may also be glued into the housing part 46, which is designed as a threaded insert. As another possibility, a pressure-tight press fit may be produced between the viewing body 50 and the housing part 46. This may take place via suitable fitting-in operations. However, producing a type of friction locking connection between viewing window 50 and associated housing part 46 is particularly preferred. As part of such a frictional locking connection, a physical and/or chemical pressure-resistant connection may form between the adjoining wall portions of viewing window 50 and housing part 46. As a further alternative solution, the housing part 46 and the viewing window 50 can be produced as a single piece, in particular, to form the housing part 46 completely from a transparent material, in particular, a pressure-resistant glass material.

While one embodiment has been chosen to illustrate the invention, it will be understood by those skilled in the art that various changes and modifications can be made therein without departing from the scope of the invention as defined in the claims.

The invention claimed is:

1. A pressure accumulator, comprising:

an accumulator housing having a gas chamber filled with a gas and a fluid chamber;

a separating element separating and sealing said gas chamber from said fluid chamber fluid-tight; and a monitoring device coupled to said accumulator housing providing a visually noticeable signal upon a disruption adversely affecting sealing of the said separating element, said monitoring device including a viewing window on a wall of said accumulator housing through which an indicator is observable from outside of said accumulator housing, said indicator having optical properties that noticeably change when said indicator is directly contacted by and wetted with fluid entering said gas chamber from said fluid chamber.

2. A pressure accumulator according to claim 1 wherein said separating element comprises a bellows.

3. A pressure accumulator according to claim 1 wherein said separating element comprises a metal bellows.

4. A pressure accumulator according to claim 1 wherein said indicator changes color when wetted with the fluid.

5. A pressure accumulator according to claim 1 wherein said indicator comprises a sample quantity of glass-fiber wool that is white in an unwetted state and that is noticeably discolored when wetted with the fluid, said glass-fiber wool being discolored in different ways when wetted with fluids of different types.

6. A pressure accumulator according to claim 5 wherein said glass-fiber wool is disposed in a bore extending through the wall of said housing to said gas chamber.

7. A pressure accumulator according to claim 6 wherein said bore is closed on an outer side of said accumulator housing by a threaded insert, said threaded insert including said viewing window, said view window being pressure-resistant.

8. A pressure accumulator according to claim 7 wherein said glass-fiber wool is disposed in said bore between said threaded insert and a screen body at an inner end of said bore.

9. A pressure accumulator according to claim 8 wherein said bore has a continuous threaded; and a threaded ring is threaded to an inner end of said continuous thread and holds said screen body.

10. A pressure accumulator according to claim 1 wherein said accumulator housing comprises a cylindrical main section and a housing cover forming an axial housing closure of said gas chamber, said monitoring device being mounted in a bore in said housing cover.

11. A pressure accumulator, comprising:

an accumulator housing having a gas chamber filled with a gas and a fluid chamber;

a separating element separating and sealing said gas chamber from said fluid chamber fluid-tight; and a monitoring device being in fluid communication with said gas chamber and being coupled to said accumulator housing providing a visually noticeable signal upon a disruption adversely affecting sealing of the said separating element, said monitoring device including a viewing window on a wall of said accumulator housing through which an indicator is observable from outside of said accumulator housing, said indicator color noticeably changing color when said indicator is directly contacted by and wetted with fluid entering said gas chamber from said fluid chamber.

12. A pressure accumulator according to claim 11 wherein said separating element comprises a bellows.

13. A pressure accumulator according to claim 11 wherein said separating element comprises a metal bellows.

14. A pressure accumulator according to claim 11 wherein said indicator comprises a sample quantity of glass-fiber wool that is white in an unwetted state and that is noticeably discolored when wetted with the fluid, said glass-fiber wool being discolored in different ways when wetted with fluids of different types.

15. A pressure accumulator according to claim 14 wherein said glass-fiber wool is disposed in a bore extending through the wall of said housing to said gas chamber.

16. A pressure accumulator according to claim 15 wherein said bore is closed on an outer side of said accumulator housing by a threaded insert, said threaded insert including said viewing window, said view window being pressure-resistant.

17. A pressure accumulator according to claim 16 wherein said glass-fiber wool is disposed in said bore between said threaded insert and a screen body at an inner end of said bore.

18. A pressure accumulator according to claim 17 wherein said bore has a continuous threaded; and a threaded ring is threaded to an inner end of said continuous thread and holds said screen body.

19. A pressure accumulator according to claim 11 wherein said accumulator housing comprises a cylindrical main section and a housing cover forming an axial housing closure of said gas chamber, said monitoring device being mounted in a bore in said housing cover.

* * * * *